US007107764B1

(12) United States Patent
Opris et al.

(10) Patent No.: US 7,107,764 B1
(45) Date of Patent: Sep. 19, 2006

(54) EXHAUST TREATMENT SYSTEM

(75) Inventors: Cornelius N. Opris, Peoria, IL (US); John P. Timmons, Chillicothe, IL (US); Mari Lou Balmer-Millar, Chillicothe, IL (US); Cho Y. Liang, Henderson, NV (US); Anil Raina, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 11/152,069

(22) Filed: Jun. 15, 2005

(51) Int. Cl.
*F01N 3/00* (2006.01)

(52) U.S. Cl. ..... 60/297; 60/274; 60/278; 60/280; 60/286; 60/303; 60/311

(58) Field of Classification Search ..... 60/274, 60/278, 280, 286, 295, 297, 30, 311, 303
See application file for complete search history.

(56) References Cited

U.S. PATENT DOCUMENTS 4,211,075 A * 7/1980 Ludecke et al. ..... 60/285
4,608,640 A 8/1986 Shinzawa et al.
5,085,049 A * 2/1992 Rim et al. ..... 60/274
5,251,564 A * 10/1993 Rim et al. ..... 110/344
5,806,308 A 9/1998 Khair et al.
5,826,428 A 10/1998 Blaschke
5,927,075 A * 7/1999 Khair ..... 60/605.2
6,276,130 B1 8/2001 Ito et al.
6,304,815 B1 10/2001 Moraal et al.
6,314,722 B1 11/2001 Matros et al.
6,338,245 B1 1/2002 Shimoda et al.
6,412,276 B1 7/2002 Salvat et al.
6,427,436 B1 8/2002 Allansson et al.
6,574,956 B1 6/2003 Moraal et al.
6,598,396 B1 7/2003 Bailey
6,625,978 B1 9/2003 Eriksson et al.
6,644,020 B1 11/2003 Kuenstler et al.
6,718,757 B1 4/2004 Khair et al.
6,738,702 B1 5/2004 Kolmanovsky et al.
6,816,771 B1 11/2004 Miura et al.
6,857,263 B1 2/2005 Gray, Jr. et al.
6,898,508 B1 5/2005 Nakano et al.
2003/0084661 A1 5/2003 Brehob
2003/0140621 A1 7/2003 Khair et al.
2003/0140622 A1 7/2003 Taylor, III et al.
2004/0050375 A1 3/2004 Arnold
2004/0103648 A1* 6/2004 Opris et al. ..... 60/285
2004/0133335 A1 7/2004 Nakano et al.
2004/0144086 A1 7/2004 Otake et al.
2004/0144087 A1 7/2004 Kondou et al.
2004/0204818 A1 10/2004 Trudell et al.
2004/0231328 A1 11/2004 Reider et al.
2004/0260452 A1 12/2004 Hamahata
2005/0000497 A1 1/2005 Nakai et al.
2005/0027431 A1 2/2005 Todoroki et al.
2005/0056017 A1 3/2005 Sisken et al.
2005/0102076 A1 5/2005 Kariya et al.
2005/0109015 A1* 5/2005 Birkby ..... 60/278
2005/0120712 A1 6/2005 Tsutsumoto et al.

* cited by examiner

*Primary Examiner*—Thomas Denion
*Assistant Examiner*—Diem Tran
(74) *Attorney, Agent, or Firm*—Finnegan,Henderson, Farabow,Garrett&Dunner

(57) ABSTRACT

An exhaust treatment system of a power source includes a filter having a housing with an inlet and an outlet, and a regeneration device disposed outside of the housing of the filter. The regeneration device is fluidly connected to the inlet of the housing. The exhaust treatment system also includes an exhaust line configured to assist in directing a portion of a filtered flow of exhaust from the filter outlet to the power source.

45 Claims, 2 Drawing Sheets

EXHAUST TREATMENT SYSTEM

TECHNICAL FIELD

The present disclosure relates generally to an exhaust treatment system and, more particularly, to an exhaust treatment system having a regeneration device.

BACKGROUND

Internal combustion engines, including diesel engines, gasoline engines, natural gas engines, and other engines known in the art, may exhaust a complex mixture of air pollutants. The air pollutants may be composed of gaseous compounds, which may include nitrous oxides (NOx), and solid particulate matter, which may include unburned carbon particulates called soot.

Due to increased attention on the environment, exhaust emission standards have become more stringent, and the amount of gaseous compounds emitted to the atmosphere from an engine may be regulated depending on the type of engine, size of engine, and/or class of engine. One method that has been implemented by engine manufacturers to comply with the regulation of these engine emissions is exhaust gas recirculation (EGR). EGR systems recirculate the exhaust gas byproducts into the intake air supply of the internal combustion engine. The exhaust gas directed to the engine cylinder reduces the concentration of oxygen within the cylinder and increases the specific heat of the air/fuel mixture, thereby lowering the maximum combustion temperature within the cylinder. The lowered maximum combustion temperature and reduced oxygen concentration can slow the chemical reaction of the combustion process and decrease the formation of NOx.

In many EGR applications, the exhaust gas is passed through a particulate filter and catalyst containing precious metals. The particulate filter may capture a portion of the solid particulate matter carried by the exhaust. After a period of use, the particulate filter may become saturated and may require cleaning through a regeneration process wherein the particulate matter is purged from the filter. In addition, the catalyst may oxidize a portion of the unburned carbon particulates contained within the exhaust gas and may convert sulfur present in the exhaust to sulfate ($SO_3$).

As shown in U.S. Pat. No. 6,427,436 (the '436 patent), a filter system can be used to remove particulate matter from a flow of engine exhaust gas before a portion of the gas is fed back to an intake air stream of the engine. Specifically, the '436 patent discloses an engine exhaust filter containing a catalyst and a filter element. A portion of the filtered exhaust is extracted downstream of the filter and is directed to an intake of the engine through a recirculation loop.

Although the filter system of the '436 patent may protect the engine from harmful particulate matter, the catalyst may convert sulfur present in the exhaust gas to sulfate. As mentioned above, the formation of sulfate may cause particulate emissions to exceed regulated levels.

The disclosed exhaust treatment system is directed to overcoming one or more of the problems set forth above.

SUMMARY OF THE INVENTION

In one embodiment of the present disclosure, an exhaust treatment system of a power source includes a filter having a housing with an inlet and an outlet, and a regeneration device disposed outside of the housing of the filter. The regeneration device is fluidly connected to the inlet of the housing. The exhaust treatment system also includes an exhaust line configured to assist in directing a portion of a filtered flow of exhaust from the filter outlet to the power source.

In another embodiment of the present disclosure, an exhaust treatment system of a combustion engine includes a filter and a regeneration device fluidly connected to the filter. The regeneration device is configured to selectively assist in increasing the temperature of an entire exhaust flow of the combustion engine to a desired temperature. The exhaust treatment system further includes an exhaust line configured to direct a portion of a filtered flow of exhaust from the filter to the combustion engine.

In yet another embodiment of the present disclosure, a method of removing matter from a filter of a combustion engine includes reducing the pressure of an exhaust flow of the engine and injecting a combustible substance into the exhaust flow upstream of the filter. The method also includes igniting the combustible substance, filtering the exhaust flow, and directing at least a portion of the filtered flow to an inlet of the engine.

DETAILED DESCRIPTION

Figure 1:
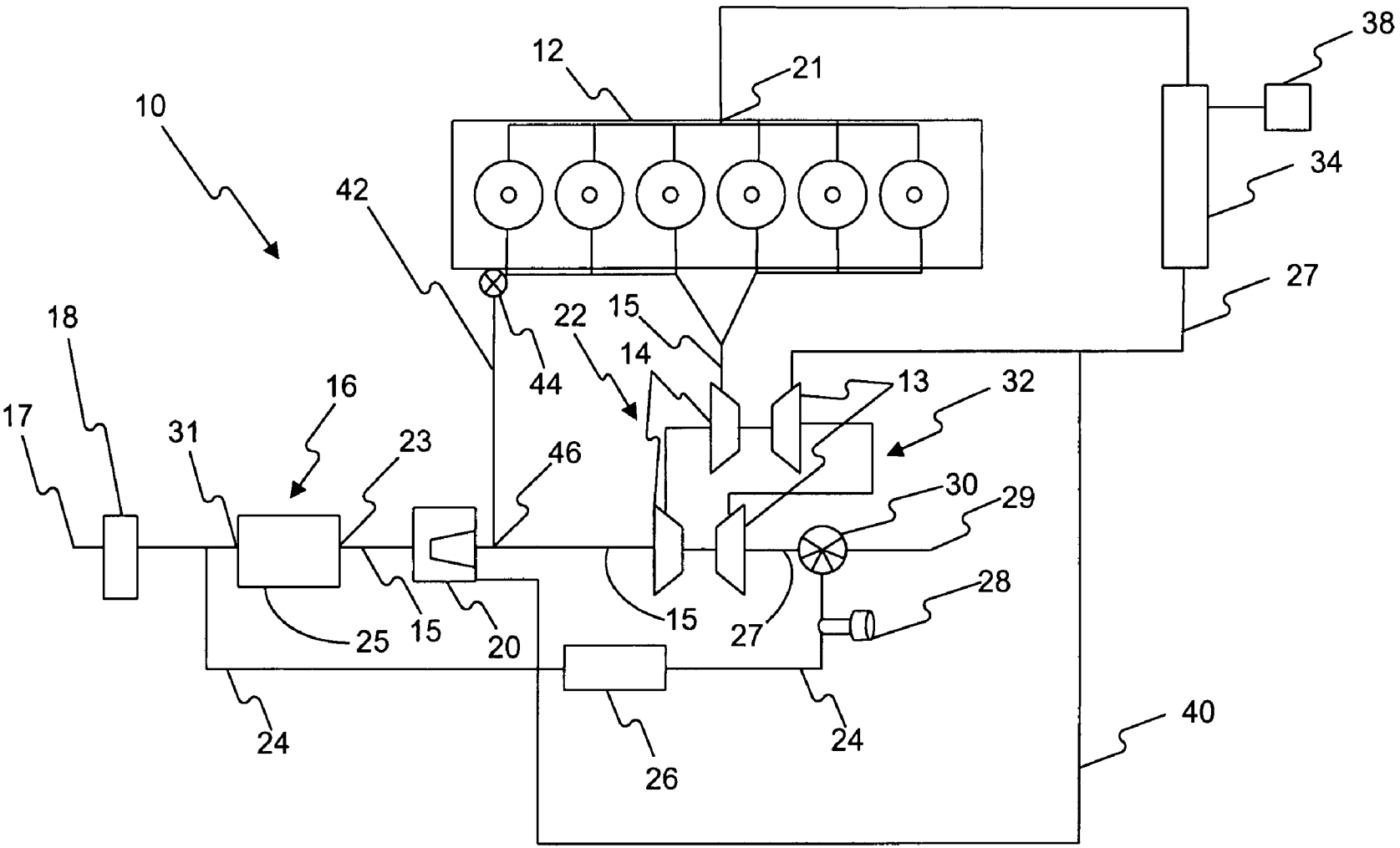
FIG. 1 is a diagrammatic illustration of an engine having an exhaust treatment system according to an exemplary embodiment of the present disclosure.

FIG. 1 illustrates a power source 12 having an exemplary exhaust treatment system 10. The power source 12 may include an engine such as, for example, a diesel engine, a gasoline engine, a natural gas engine, or any other engine apparent to one skilled in the art. The power source 12 may, alternately, include another source of power such as a furnace or any other source of power known in the art.

The exhaust treatment system 10 may be configured to direct exhaust gases out of the power source 12, treat the gases, and introduce a portion of the treated gases into an intake 21 of the power source 12. The exhaust treatment system 10 may include an energy extraction assembly 22, a regeneration device 20, a filter 16, a catalyst 18, a recirculation line 24 fluidly connected between the filter 16 and the catalyst 18, and a flow cooler 26. The exhaust treatment system 10 may further include a flow sensor 28, a mixing valve 30, a compression assembly 32, and an aftercooler 34.

A flow of exhaust produced by the power source 12 may be directed from the power source 12 to components of the exhaust treatment system 10 by flow lines 15. The flow lines 15 may include pipes, tubing, and/or other exhaust flow carrying means known in the art. The flow lines 15 may be made of alloys of steel, aluminum, and/or other materials known in the art. The flow lines 15 may be rigid or flexible, and may be capable of safely carrying high temperature exhaust flows, such as flows having temperatures in excess of 700 degrees Celsius (approximately 1,292 degrees Fahrenheit).

The energy extraction assembly 22 may be configured to extract energy from, and reduce the pressure of, the exhaust gases produced by the power source 12. The energy extraction assembly 22 may be fluidly connected to the power source 12 by one or more flow lines 15 and may reduce the pressure of the exhaust gases to any desired pressure. The energy extraction assembly 22 may include one or more turbines 14, diffusers, or other energy extraction devices known in the art. In an exemplary embodiment wherein the energy extraction assembly 22 includes more than one turbine 14, the multiple turbines 14 may be disposed in parallel or in series relationship. It is also understood that in an embodiment of the present disclosure, the energy extraction assembly 22 may, alternately, be omitted. In such an embodiment, the power source 12 may include, for example, a naturally aspirated engine. As will be described in greater detail below, a component of the energy extraction assembly 22 may be configured in certain embodiments to drive a component of the compression assembly 32.

In an exemplary embodiment, the regeneration device 20 may be fluidly connected to the energy extraction assembly 22 via flow line 15, and may be configured to increase the temperature of an entire flow of exhaust produced by the power source 12 to a desired temperature. The desired temperature may be, for example, a regeneration temperature of the filter 16. Accordingly, the regeneration device 20 may be configured to assist in regenerating the filter 16. Alternatively, in another exemplary embodiment the regeneration device 20 may be configured to increase the temperature of only a portion of the entire flow of exhaust produced by the power source 12. The regeneration device 20 may include, for example, a fuel injector and an ignitor (not shown), heat coils (not shown), and/or other heat sources known in the art. Such heat sources may be disposed within the regeneration device 20 and may be configured to assist in increasing the temperature of the flow of exhaust through convection, combustion, and/or other methods. In an exemplary embodiment in which the regeneration device 20 includes a fuel injector and an ignitor, it is understood that the regeneration device 20 may receive a supply of a combustible substance and a supply of oxygen to facilitate combustion within the regeneration device 20. The combustible substance may be, for example, gasoline, diesel fuel, reformate, and/or any other combustible substance known in the art. The supply of oxygen may be provided in addition to the relatively low pressure flow of exhaust gas directed to the regeneration device 20 through flow line 15. In an exemplary embodiment, the supply of oxygen may be carried by a flow of gas directed to the regeneration device 20 from downstream of the compression assembly 32 via a supply line 40. In such an embodiment, the flow of gas may include, for example, recirculated exhaust gas and ambient air. It is understood that, in an exemplary embodiment of the present disclosure, the supply line 40 may be fluidly connected to an outlet of the compression assembly 32. In an exemplary embodiment, the regeneration device 20 may be dimensioned and/or otherwise configured to be housed within an engine compartment or other compartment of a work machine (not shown) to which the power source 12 is attached. In such an embodiment, the regeneration device 20, may be desirably calibrated in conjunction with, for example, the filter 16, the energy extraction assembly 22, the catalyst 18, and/or the power source 12. Calibration of the regeneration device 20 may include, for example, among other things, adjusting the rate, angle, and/or atomization at which fuel is injected into the regeneration device 20, adjusting the flow rate of the oxygen supplied, adjusting the intensity and/or firing pattern of the ignitor, and adjusting the length, diameter, mounting angle, and/or other configurations of a housing of the regeneration device 20. Such calibration may reduce the time required to regenerate the filter 16 and the amount of fuel or other combustible substances needed for regeneration. Either of these results may improve the overall efficiency of the exhaust treatment system 10. It is understood that the efficiency of the exhaust treatment systems 10, 100 described herein may be measured by a variety of factors including, among other things, the amount of fuel used for regeneration, the length of the regeneration period, and the amount (parts per million) of pollutants released to the atmosphere.

As shown in FIG. 1, the filter 16 may be connected downstream of the regeneration device 20. The filter 16 may have a housing 25 including an inlet 23 and an outlet 31. In an exemplary embodiment, the regeneration device 20 may be disposed outside of the housing 25 and may be fluidly connected to the inlet 23 of the housing 25. In another exemplary embodiment, the regeneration device 20 may be disposed within the housing 25 of the filter 16. The filter 16 may be any type of filter known in the art capable of extracting matter from a flow of gas. In an embodiment of the present disclosure, the filter 16 may be, for example, a particulate matter filter positioned to extract particulates from an exhaust flow of the power source 12. The filter 16 may include, for example, a ceramic substrate, a metallic mesh, foam, or any other porous material known in the art. These materials may form, for example, a honeycomb structure within the housing 25 of the filter 16 to facilitate the removal of particulates. The particulates may be, for example, soot.

In an exemplary embodiment of the present disclosure, a portion of the exhaust produced by the combustion process may leak past piston rings within a crankcase (not shown) of the power source 12. This portion of the exhaust may build up within the crankcase over time, thereby increasing the pressure within the crankcase. In such an embodiment, a ventilation line 42 may be fluidly connected to the crankcase of the power source 12. The ventilation line 42 may comprise piping, tubing, and/or other exhaust flow carrying means known in the art and may be structurally similar to the flow lines 15 described above. The ventilation line 42 may be configured to direct, for example, the portion of exhaust gas from the crankcase to a port 46 of the flow line 15. The port 46 may be located in the flow line 15 anywhere upstream of the filter 16. For example, the ventilation line 42 may assist in directing the portion of exhaust gas from the crankcase to a port 46 disposed upstream of the regeneration device 20. The ventilation line 42 may include, for example, a check valve 44 and/or any other valve assembly known in the art. The check valve 44 may be configured to assist in controllably regulating a flow of fluid through the ventilation line 42.

The exhaust treatment system 10 may further include a catalyst 18 disposed downstream of the filter 16. The catalyst 18 may contain catalyst materials useful in collecting, absorbing, adsorbing, and/or storing hydrocarbons, oxides of sulfur, and/or oxides of nitrogen contained in a flow. Such catalyst materials may include, for example, aluminum, platinum, palladium, rhodium, barium, cerium, and/or alkali metals, alkaline-earth metals, rare-earth metals, or combinations thereof. The catalyst materials may be situated within the catalyst 18 so as to maximize the surface area available for the collection of, for example, hydrocarbons. The catalyst 18 may include, for example, a ceramic substrate, a metallic mesh, foam, or any other porous material known in the art, and the catalyst materials may be located on, for example, a substrate of the catalyst 18.

Figure 2:
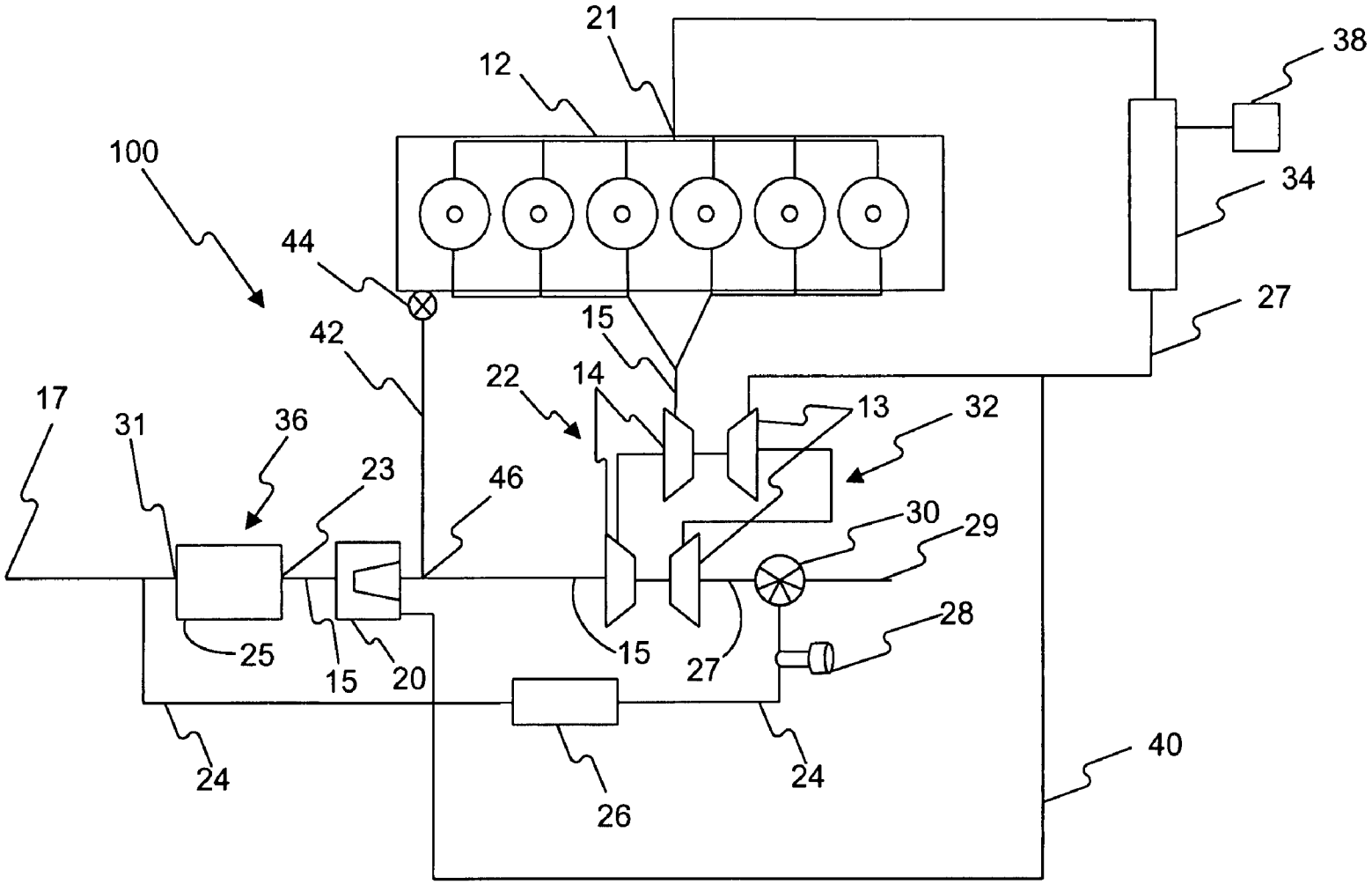
FIG. 2 is a diagrammatic illustration of an engine having an exhaust treatment system according to another exemplary embodiment of the present disclosure.

As illustrated in FIG. 2, in an additional exemplary embodiment of the present disclosure, a filter 36 of the exhaust treatment system 100 may include catalyst materials useful in collecting, absorbing, adsorbing, and/or storing hydrocarbons, oxides of sulfur, and/or oxides of nitrogen contained in a flow. In such an embodiment, the catalyst 18 (FIG. 1) may be omitted. The catalyst materials may include, for example, any of the catalyst materials discussed above with respect to the catalyst 18 (FIG. 1). The catalyst materials may be situated within the filter 36 so as to maximize the surface area available for absorption, adsorption, and or storage. The catalyst materials may be located on a substrate of the filter 36. The catalyst materials may be added to the filter 36 by any conventional means such as, for example, coating or spraying, and the substrate of the filter 36 may be partially or completely coated with the materials. It is understood that the presence of catalyst materials, such as, for example, platinum and/or palladium, upstream of the recirculation line 24 may result in the formation of sulfate in the exhaust treatment system 100. Accordingly, to minimize the amount of sulfate formed in the exemplary embodiment of FIG. 2, only minimal amounts of catalyst materials may be incorporated into the filter 36.

It is also understood that the catalyst materials described above with respect to FIGS. 1 and 2 may be capable of oxidizing hydrocarbons in certain conditions. Thus, in the embodiment shown in FIG. 1, a portion of the hydrocarbons contained within the exhaust flow may be permitted to travel back to the power source 12 without being oxidized by the catalyst materials. It is further understood that although the catalyst materials discussed above may assist in the formation of sulfate, the presence of these catalyst materials, either on a substrate of the filter 36 (FIG. 2) or in the catalyst 18 (FIG. 1), may improve the overall emissions characteristics of the exhaust treatment system 10, 100 by removing hydrocarbons from the treated exhaust flow.

Referring again to FIG. 1, the exhaust treatment system 10 may further include a recirculation line 24 fluidly connected downstream of the filter 16. The recirculation line 24 may be disposed between the filter 16 and the catalyst 18 and may be configured to assist in directing a portion of the exhaust flow from the filter 16 to the inlet 21 of the power source 12. The recirculation line 24 may comprise piping, tubing, and/or other exhaust flow carrying means known in the art and may be structurally similar to the flow lines 15 described above. In an embodiment in which the exhaust treatment system 100 (FIG. 2) includes a filter 36 containing catalyst materials, the recirculation line 24 may be disposed downstream of the filter 36 and upstream of an exhaust system outlet 17.

The flow cooler 26 may be fluidly connected to the filter 16 via the recirculation line 24 and may be configured to cool the portion of the exhaust flow passing through the recirculation line 24. The flow cooler 26 may include a liquid-to-air heat exchanger, an air-to air heat exchanger, or any other type of heat exchanger known in the art for cooling an exhaust flow. In an alternative exemplary embodiment of the present disclosure, the flow cooler 26 may be omitted.

The mixing valve 30 may be fluidly connected to the flow cooler 26 via the recirculation line 24 and may be configured to assist in regulating the flow of exhaust through the recirculation line 24. It is understood that in an exemplary embodiment, a check valve (not shown) may be fluidly connected upstream of the flow cooler 26 to further assist in regulating the flow of exhaust through the recirculation line 24. The mixing valve 30 may be a spool valve, a shutter valve, a butterfly valve, a check valve, a diaphragm valve, a gate valve, a shuttle valve, a ball valve, a globe valve, or any other valve known in the art. The mixing valve 30 may be actuated manually, electrically, hydraulically, pneumatically, or in any other manner known in the art. The mixing valve 30 may be in communication with a controller (not shown) and may be selectively actuated in response to one or more predetermined conditions.

The mixing valve 30 may also be fluidly connected to an ambient air intake 29 of the exhaust treatment system 10. Thus, the mixing valve 30 may be configured to control the amount of exhaust flow entering a flow line 27 relative to the amount of ambient air flow entering the flow line 27. For example, as the amount of exhaust flow passing through the mixing valve 30 is desirably increased, the amount of ambient air flow passing through the mixing valve 30 may be proportionally decreased and vise versa.

As shown in FIG. 1, the flow sensor 28 may be fluidly connected to the recirculation line 24 downstream of the flow cooler 26. The flow sensor 28 may be any type of mass air flow sensor such as, for example, a hot wire anemometer or a venturi-type sensor. The flow sensor 28 may be configured to sense the amount of exhaust flow passing through the recirculation line 24. It is understood that the flow cooler 26 may assist in reducing fluctuations in the temperature of the portion of the exhaust flow passing through the recirculation line 24. Reducing temperature fluctuations may also assist in reducing fluctuations in the volume occupied by a flow of exhaust gas since a high temperature mass of gas occupies a greater volume than the same mass of gas at a low temperature gases. Thus, sensing the amount of exhaust flow through the recirculation line 24 at positions downstream of the flow cooler 26 (i.e. at a relatively controlled temperature) may result in more accurate flow measurements than measurements taken upstream of the flow cooler 26. It is further understood that the flow sensor 28 may also include, for example, a thermocouple (not shown) or other device configured to sense the temperature of the exhaust flow.

The flow line 27 downstream of the mixing valve 30 may direct the ambient air/exhaust flow mixture to the compression assembly 32. The compression assembly 32 may include a compressor 13 configured to increase the pressure of a flow of gas a desired pressure. The compressor 13 may include a fixed geometry type compressor, a variable geometry type compressor, or any other type of compressor known in the art. In the exemplary embodiment shown in FIG. 1, the compression assembly 32 may include more than one compressor 13 and the multiple compressors 13 may be disposed in parallel or in series relationship. A compressor 13 of the compression assembly 32 may be connected to a turbine 14 of the energy extraction assembly 22 and the turbine 14 may be configured to drive the compressor 13. In particular, as hot exhaust gases exit the power source 12 and expand against the blades (not shown) of the turbine 14, components of the turbine 14 may rotate and drive the connected compressor 13. Alternatively, in an embodiment in which the turbine 14 is omitted, the compressor 13 may be driven by, for example, the power source 12, or by any other drive known in the art. It is also understood that in a non-pressurized air induction system, the compression assembly 32 may be omitted.

The aftercooler 34 may be fluidly connected to the power source 12 via the flow line 27 and may be configured to cool a flow of gas passing through the flow line 27. In an exemplary embodiment, this flow of gas may be the ambient air/exhaust flow mixture discussed above. The aftercooler 34 may include a liquid-to-air heat exchanger, an air-to air heat exchanger, or any other type of flow cooler or heat exchanger known in the art. In an exemplary embodiment of the present disclosure, the aftercooler 34 may be omitted if desired.

The exhaust treatment system 10 may further include a condensate drain 38 fluidly connected to the aftercooler 34. The condensate drain 38 may be configured to collect a fluid, such as, for example, water or other condensate formed at the aftercooler 34. It is understood that such fluids may consist of, for example, condensed water vapor contained in recycled exhaust gas and/or ambient air. In such an exemplary embodiment, the condensate drain 38 may include a removably attachable fluid tank (not shown) capable of safely storing the condensed fluid. The fluid tank may be configured to be removed, safely emptied, and reconnected to the condensate drain 38. In another exemplary embodiment, the condensate drain 38 may be configured to direct the condensed fluid to a fluid container (not shown) and/or other component or location on the work machine. Alternatively, the condensate drain 38 may be configured to direct the fluid to the atmosphere or to the surface by which the work machine is supported.

INDUSTRIAL APPLICABILITY

The exhaust treatment systems 10, 100 of the present disclosure may be used with any combustion-type device such as, for example, an engine, a furnace, or any other device known in the art where the recirculation of reduced-particulate exhaust into an inlet of the device is desired. The exhaust treatment systems 10, 100 may be useful in reducing the amount of harmful exhaust emissions discharged to the environment and reducing or substantially eliminating the amount of sulfate produced during treatment of the exhaust gas. The exhaust treatment systems 10, 100 may also be capable of purging the portions of the exhaust gas captured by components of the system through a regeneration process.

As discussed above, the combustion process may produce a complex mixture of air pollutants. These pollutants may exist in solid, liquid, and/or gaseous form. In general, the solid and liquid pollutants may fall into the three categories of soot, soluble organic fraction, and sulfates. The soot produced during combustion may include carbonaceous materials, and the soluble organic fraction may include unburned hydrocarbons that are deposited on or otherwise chemically combined with the soot. The sulfates produced in the combustion process may be formed from sulfur molecules contained within the fuel and may be released in the form of $SO_2$. This $SO_2$ may react with oxygen molecules contained within the exhaust flow to form $SO_3$. As explained above, $SO_2$ may also be converted into $SO_3$ in the presence of, for example, platinum, palladium, and/or other rare earth metals used as catalyst materials in conventional catalysts. It is understood that the combustion process may also produce small amounts of $SO_3$.

In a conventional exhaust treatment system, a portion of the $SO_3$ produced may be released to the atmosphere through an outlet of the exhaust system. The exhaust treatment systems 10, 100 of the present disclosure, however, may substantially reduce the formation of sulfates by minimizing the amount of platinum, palladium, and/or other precious earth metals used. The operation of the exhaust treatment systems 10, 100 will now be explained in detail. Unless otherwise noted, the exhaust treatment system 10 of FIG. 1 will be referred to for the duration of the disclosure.

The power source 12 may combust a mixture of fuel, recirculated exhaust gas, and ambient air to produce mechanical work and an exhaust flow containing the gaseous compounds discussed above. The exhaust flow may be directed, via flow line 15, from the power source 12 through the energy extraction assembly 22. The hot exhaust flow may expand on the blades of the turbines 14 of the energy extraction assembly 22, and this expansion may reduce the pressure of the exhaust flow while assisting in rotating the turbine blades.

The reduced pressure exhaust flow may pass through the regeneration device 20 to the filter 16. The regeneration device 20 may be deactivated during the normal operation of the power source 12. As the exhaust flow passes through the filter 16, a portion of the particulate matter entrained with the exhaust flow may be captured by the substrate, mesh, and/or other structures within the filter 16.

A portion of the filtered exhaust flow may be extracted downstream of the filter 16 and upstream of the catalyst 18. The extracted portion of the exhaust flow may enter the recirculation line 24 and may be recirculated back to the power source 12. The remainder of the filtered exhaust flow may pass through the catalyst 18. The catalyst materials contained within the catalyst may assist in oxidizing the hydrocarbons and soluble organic fraction carried by the filtered flow. After passing through the catalyst 18, the remainder of the filtered exhaust flow may exit the exhaust treatment system 10 through an exhaust system outlet 17.

The embodiment of the exhaust treatment system 10 illustrated in FIG. 1 may be preferable to conventional systems since, although the exhaust treatment system 10 contains a separate catalyst 18, the catalyst 18 is downstream of the recirculation line 24. As a result, any of the $SO_3$ produced by the rare earth metals contained within the catalyst 18 exits through the outlet 17 and is not recirculated through the exhaust treatment system 10. It is understood, however, that since the catalyst 18 is downstream of the recirculation line 24, a portion of the hydrocarbons produced during the combustion process may be recirculated back to the power source 12.

In the exemplary embodiment illustrated in FIG. 2, the filter 36 may contain small amounts of catalyst materials such as platinum. The catalyst materials may be disposed on a substrate of the filter 36 and may substantially oxidize the hydrocarbons and soluble organic fraction contained within the exhaust flow. Such a configuration may result in the production of substantially less sulfate in the recirculated filtered exhaust flow than conventional exhaust treatment systems containing a separate catalyst upstream of a filter.

Referring again to FIG. 1, the recirculated portion of the exhaust flow may pass through the flow cooler 26. The flow cooler 26 may reduce the temperature of the portion of the exhaust flow before the portion enters the flow line 27. The mixing valve 30 may be configured to regulate the ratio of recirculated exhaust flow to ambient inlet air passing through flow line 27. As described above, the flow sensor 28 may assist in regulating this ratio.

The mixing valve 30 may permit the ambient air/exhaust flow mixture to pass to the compression assembly 32 where the compressors 13 may increase the pressure of the flow, thereby increasing the temperature of the flow. The compressed flow may pass through the flow line 27 to the aftercooler 34, which may reduce the temperature of the flow before the flow enters the inlet 21 of the power source 12.

Over time, soot produced by the combustion process may collect in the filter 16 and may begin to impair the ability of the filter 16 to store particulates. The flow sensor 28 and other sensors (not shown) sense parameters of the power source 12 and/or the exhaust treatment system 10. Such parameters may include, for example, engine speed, engine temperature, exhaust flow temperature, exhaust flow pressure, and particulate matter content. A controller (not shown) may use the information sent from the sensors in conjunction with an algorithm or other pre-set criteria to determine whether the filter 16 has become saturated and is in need of regeneration. Once this saturation point has been reached, the controller may send appropriate signals to components of the exhaust treatment system 10 to begin the regeneration process. A preset algorithm stored in the controller may assist in this determination and may use the sensed parameters as inputs. Alternatively, regeneration may commence according to a set schedule based on fuel consumption, hours of operation, and/or other variables.

The signals sent by the controller may alter the position of the mixing valve 30 to desirably alter the ratio of the ambient air/exhaust flow mixture. These signals may also activate the regeneration device 20. Upon activation, oxygen and a combustible substance, such as, for example, fuel may be directed to the regeneration device 20. The regeneration device 20 may ignite the fuel and may increase the temperature of the exhaust flow passing to the filter 16 to a desired temperature for regeneration. This temperature may be in excess of 700 degrees Celsius (approximately 1,292 degrees Fahrenheit) in some applications, depending on the type and size of the filter 16. At these temperatures, soot contained within the filter 16 may be burned away to restore the storage capabilities of the filter 16.

Other embodiments of the disclosed exhaust treatment system 10, 100 will be apparent to those skilled in the art from consideration of the specification. For example, the system 10, 100 may include additional filters such as, for example, a sulfur trap disposed upstream of the filter 16. The sulfur trap may be useful in capturing sulfur molecules carried by the exhaust flow. It is intended that the specification and examples be considered as exemplary only, with the true scope of the invention being indicated by the following claims.

What is claimed is:

1. An exhaust treatment system of a power source, comprising:

a filter having a housing with an inlet and an outlet;

a regeneration device disposed outside of the housing of the filter and fluidly connected to the inlet of the housing;

a supply line configured to assist in directing a flow comprising recirculated exhaust and ambient air to the regeneration device; and an exhaust line configured to assist in directing a portion of a filtered flow of exhaust from the filter outlet to the power source.

2. The system of claim 1, wherein the regeneration device is configured to ignite a combustible substance to assist in increasing the temperature of a flow of exhaust gas.

3. The system of claim 1, further including a flow cooler configured to receive a portion of the filtered flow from the filter.

4. The system of claim 1, further including an aftercooler configured to cool a flow of gas supplied to the power source.

5. The system of claim 1, wherein the regeneration device includes an injector and an ignitor.

6. The system of claim 1, wherein the regeneration device is configured to increase a temperature of at least a portion of an unfiltered flow of exhaust.

7. The system of claim 1, wherein the regeneration device is disposed within an engine compartment of a machine to which the power source is attached.

8. The system of claim 1, further including a catalyst configured to receive at least a portion of the filtered flow from the filter.

9. The system of claim 8, wherein the catalyst is an oxidation catalyst.

10. The system of claim 8, wherein the catalyst is disposed downstream of the exhaust line.

11. The system of claim 8, wherein the exhaust line is fluidly connected between the filter and the catalyst.

12. The system of claim 1, wherein the filter contains a catalyst material.

13. The system of claim 12, wherein the catalyst material is a precious metal.

14. The system of claim 1, further including an energy extraction assembly disposed upstream of the regeneration device and configured to reduce the pressure of an exhaust flow from the power source.

15. The system of claim 14, wherein the energy extraction assembly includes at least one turbine.

16. The system of claim 1, further including a compression assembly configured to supply a pressurized gas flow to the power source.

17. The system of claim 16, wherein the pressurized gas flow includes ambient intake air and filtered exhaust.

18. The system of claim 16, wherein the compression assembly includes at least one compressor.

19. The system of claim 16, wherein the supply line is fluidly connected to an outlet of the compression assembly.

20. The system of claim 1, wherein the regeneration device includes a housing having an inlet and an outlet.

21. The system of claim 20, further including a flow line fluidly connecting the outlet of the regeneration device housing to the inlet of the filter housing.

22. The system of claim 20, wherein the inlet of the regeneration device housing is configured to receive an entire unfiltered flow of exhaust from the power source.

23. An exhaust treatment system of a combustion engine, comprising:

a filter;

a regeneration device fluidly connected to the filter and configured to selectively assist in increasing the temperature of an entire exhaust flow of the combustion engine to a desired temperature;

a supply line configured to assist in directing a flow comprising recirculated exhaust and ambient air to the regeneration device; and an exhaust line configured to direct a portion of a filtered flow of exhaust from the filter to the combustion engine.

24. The system of claim 23, wherein the filter contains a catalyst material.

25. The system of claim 24, wherein the catalyst material is a precious metal.

26. The system of claim 23, wherein the regeneration device is configured to ignite a combustible substance to assist in increasing the temperature of a flow of exhaust gas.

27. The system of claim 23, wherein the regeneration device further includes an injector and an ignitor.

28. The system of claim 23, wherein the regeneration device is disposed within an engine compartment of a machine to which the combustion engine is attached.

29. The system of claim 23, further including a catalyst configured to receive at least a portion of the filtered flow from the filter.

30. The system of claim 29, wherein the catalyst is an oxidation catalyst.

31. The system of claim 29, wherein the catalyst is disposed downstream of the exhaust line.

32. The system of claim 29, wherein the exhaust line is fluidly connected between the filter and the catalyst.

33. The system of claim 29, wherein the at least a portion of the filtered flow of exhaust is directed to a system outlet.

34. The system of claim 23, wherein the regeneration device includes a housing having an inlet and an outlet.

35. The system of claim 23, wherein the inlet of the regeneration device housing is configured to receive an entire unfiltered flow of exhaust from the combustion engine.

36. The system of claim 23, further including a compression assembly configured to supply a pressurized gas flow to the combustion engine.

37. The system of claim 36, wherein the supply line is fluidly connected to an outlet of the compression assembly.

38. A method of removing matter from a filter of a combustion engine, comprising:

reducing the pressure of an exhaust flow of the engine;

injecting a combustible substance into the exhaust flow upstream of the filter;

igniting the combustible substance;

filtering the exhaust flow and directing at least a first portion of the filtered flow to an inlet of the engine; and directing a supply flow to a regeneration device disposed upstream of the filter, the supply flow comprising a second portion of the filtered flow and ambient air.

39. The method of claim 38, wherein reducing the pressure of the exhaust flow includes passing the exhaust flow through a turbine.

40. The method of claim 38, wherein the pressure of the exhaust flow is reduced upstream of the regeneration device.

41. The method of claim 38, wherein the method of removing matter from the filter is triggered by a sensed parameter.

42. The method of claim 38, wherein the method of removing matter from the filter is triggered based on a predetermined schedule.

43. The method of claim 38, wherein the regeneration device is configured to increase a temperature of at least a portion of the unfiltered exhaust flow.

44. The method of claim 38, wherein the regeneration device is configured to assist in injecting the combustible substance and igniting the combustible substance.

45. The method of claim 38, further including increasing the pressure of at least one of the first portion, the second portion, and the ambient air.

* * * * *